US009018549B2

(12) United States Patent
Grül et al.

(10) Patent No.: US 9,018,549 B2
(45) Date of Patent: Apr. 28, 2015

(54) LOCKING APPARATUS FOR AN ELECTROMECHANICAL SWITCHING DEVICE HAVING A MANUAL ACTUATION OPTION

(75) Inventors: Klaus Grül, Alfter (DE); Harald Krieger, Neuhaus (DE); Libor Krivanek, Kunvald v Cechách (CZ)

(73) Assignee: Siemens Aktiengesellschaft, Munich (DE)

( * ) Notice: Subject to any disclaimer, the term of this patent is extended or adjusted under 35 U.S.C. 154(b) by 260 days.

(21) Appl. No.: 13/602,622

(22) Filed: Sep. 4, 2012

(65) Prior Publication Data

US 2013/0056336 A1 Mar. 7, 2013

(30) Foreign Application Priority Data

Sep. 7, 2011 (DE) ..... 10 2011 082 255

(51) Int. Cl.
*H01H 9/28* (2006.01)

(52) U.S. Cl.
CPC ..... *H01H 9/286* (2013.01)

(58) Field of Classification Search
USPC ..... 200/43.01, 43.11, 43.14–43.16, 43.19, 200/43.22, 50.3, 50.33, 331, 332, 50.14
See application file for complete search history.

(56) References Cited

U.S. PATENT DOCUMENTS

| | | | | |
|---|---|---|---|---|
| 4,260,861 A | | 4/1981 | DiMarco | |
| 4,882,456 A | * | 11/1989 | Hovanic et al. | 200/43.15 |
| 5,322,980 A | * | 6/1994 | Benda | 200/43.14 |
| 5,905,236 A | | 5/1999 | Green | |

FOREIGN PATENT DOCUMENTS

| | | |
|---|---|---|
| DE | 69022333 T2 | 4/1996 |
| DE | 69812626 T2 | 2/2004 |

OTHER PUBLICATIONS

German Office Action for German Application No. DE 10 2011 082 255.0 dated Jun. 19, 2012.
Priority Document German Application No. DE 10 2011 082 255.0 filed Sep. 7, 2011.
Abstract of EP 0412023 A1 corresponding to DE 69022333 T2.
Abstract of WO 9859352 A1 corresponding to DE 69812626 T2.

* cited by examiner

*Primary Examiner* — Edwin A. Leon
*Assistant Examiner* — Anthony R. Jimenez
(74) *Attorney, Agent, or Firm* — Harness, Dickey & Pierce, P.L.C.

(57) ABSTRACT

A locking apparatus is disclosed for an electromechanical switching device having a manual actuation option. Furthermore, such a switching device is also disclosed. A robust, mechanically simple locking apparatus is provided which can be operated without a tool, as well as a correspondingly embodied switching device. The locking apparatus of at least one embodiment includes a combination of few interacting construction elements attuned to one another in terms of structure and function. In this apparatus, a locking element assumes a double function, by, on the one hand, securing the connection of the locking apparatus with the switching device and on the other hand preventing a change in position of the actuation element of the switching device.

18 Claims, 7 Drawing Sheets

LOCKING APPARATUS FOR AN ELECTROMECHANICAL SWITCHING DEVICE HAVING A MANUAL ACTUATION OPTION

PRIORITY STATEMENT

The present application hereby claims priority under 35U.S.C. §119 to German patent application number DE 10 2011 082 255.0 filed Sep. 7, 2011, the entire contents of which are hereby incorporated herein by reference.

FIELD

At least one embodiment of the invention generally relates to a locking apparatus for an electromechanical switching device having a manual actuation option. Furthermore, at least one embodiment of the invention generally relates to such a switching device.

BACKGROUND

Electromechanical switching devices with a manual actuation option are known from the prior art. The device is preferably actuated manually by way of a rotary switch or a rocker arm.

To prevent unwanted and/or unauthorized actuation of the switching device, it is known to lock the actuation element in the securing position ("OFF" position) with the aid of a locking apparatus which can be fastened to the switching device. This locking can often be additionally secured with the aid of a lock, for instance a U-lock or suchlike.

Locking apparatuses known from the prior are frequently restricted in terms of function or are however complicated or laborious to operate. Installation on the switching device is therefore often only possible with special tools. The apparatuses known previously are also frequently not stable enough to withstand greater mechanical loads. Furthermore, with the solutions known from the prior art, it is also disadvantageous if the locking apparatuses require a comparatively large amount of installation space. In some cases labeling on the surface of the switching device, such as for instance technical data of the switching device, is hidden. In addition, the known locking apparatuses are often unsuited to use in distributors on account of their size.

SUMMARY

At least one embodiment of the present invention provides a robust locking apparatus which can be operated without a tool and is constructed in a mechanically simple manner, as well as a correspondingly embodied switching device. Advantageous embodiments of the invention are specified in the subclaims.

The inventive locking apparatus of at least one embodiment is fastened to the switching device with at least one fastening element. The connected position of the fastening elements is secured by a locking element provided this locking element is transferred into its locking position. A core idea behind the invention consists in the locking element in this state simultaneously preventing a change in position of the actuation element of the switching device. In other words, the locking element fulfills a double function, by securing the positions of two different construction elements, namely the position of the at least one fastening element of the locking apparatus on the one hand and the position of the actuation element of the switching device on the other hand.

BRIEF DESCRIPTION OF THE DRAWINGS

The afore-described properties, features and advantages of this invention as well the manner in which they are achieved will become clearer and more succinct in conjunction with the following description of the example embodiments, which are explained in more detail below in conjunction with the drawings, in which.

All figures only show the invention schematically and with its essential components. The same reference characters correspond here to elements with the same or comparable function.

DETAILED DESCRIPTION OF THE EXAMPLE EMBODIMENTS

Figure 1:
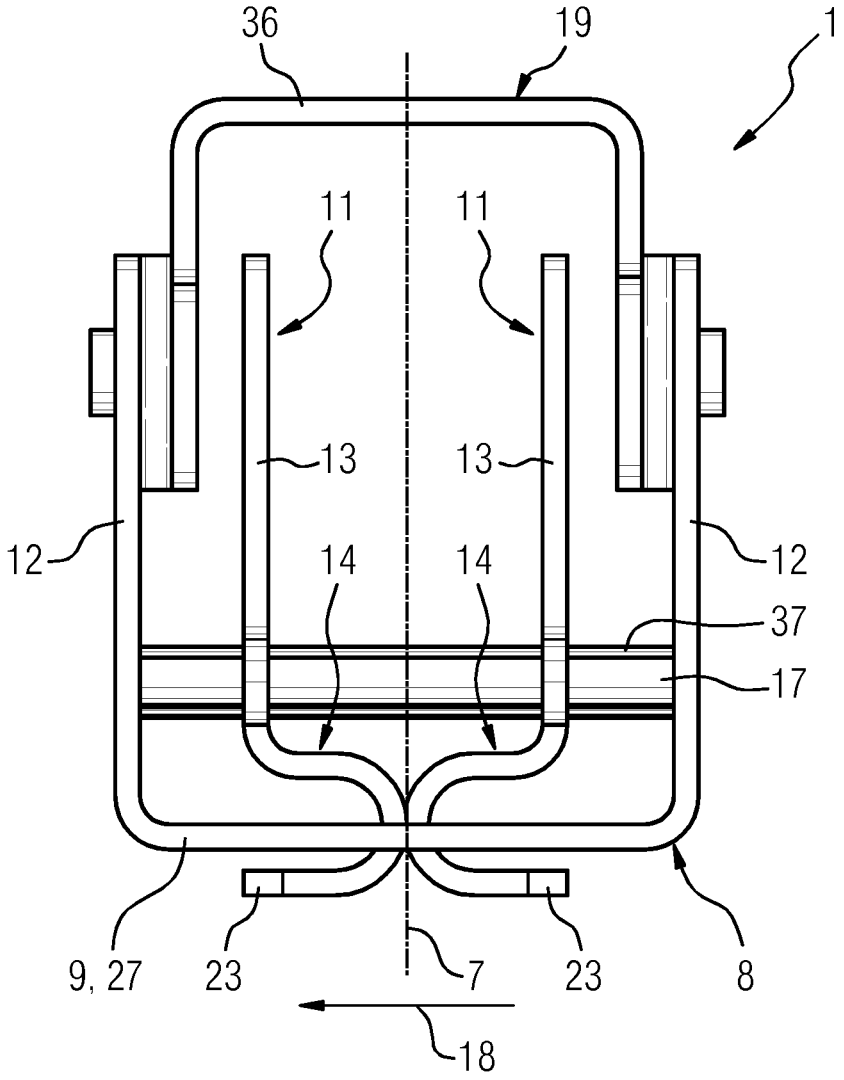
FIG. 1 shows a side view of the locking apparatus in a longitudinal direction (separated position)

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

At least one embodiment of the inventive locking apparatus is an apparatus which is only to be mounted temporarily on the switching device. The double function of the locking element on the one hand ensures that a locking apparatus which is fixedly connected to the switching device also always reliably prevents a change in position of the actuation element. On the other hand, it is herewith ensured that when the actuation element is locked, the locking apparatus is always fixedly and securely connected to the switching device. The double function of the locking element therefore fulfills an important securing function, since it prevents an unintentional release of the locking apparatus from the switching device, as well as an unintentional release of the locking of the actuation element in the desired position.

The fastening elements used are however also structurally embodied such that they assume a double function. On the one hand, they are used to secure the mechanical connection of the locking apparatus with the switching device, by having lateral surfaces which are fixed in the locking position between the base body and the locking element. On the other hand, they allow the locking to be closed by openings for a lock or suchlike being provided in the lateral surfaces.

A locking apparatus is provided with at least one embodiment of the present invention, which is developed in a particularly simple manner. It includes a combination of a few, interlocking construction elements which are attuned to one another in terms of structure and function. The simple tool-free installation of the locking apparatus takes place directly on the actuation element of the switching device. The locking apparatus only requires very little installation space. Labeling on the surface of the switching device is not hidden. The compact structure provides for high mechanical load. Strict load standards (UL, NFPA 70E) can also be fulfilled (e.g. NFPA 70E-120.2(E)(5), Note 3). The minimal required space also enables use of the inventive locking apparatus in distributors. Locking the actuation element of the switching device in the securing position is possible, as is an optional, additional securing of the locking process by means of closure. By removing a securing element, the locking apparatus can also be used to lock the "ON" position of the switching device. Closure of the locking apparatus is also possible in this case.

At least one embodiment of the invention is suited to any electromechanical switching devices having a manual actuation option. The use in circuit breakers is particularly advantageous, e.g. MCCBs.

An embodiment of the inventive locking apparatus 1, see FIGS. 1 to 6, is embodied to interact with a circuit breaker 2 having a manual actuation option, see FIGS. 7 to 10. The circuit breaker 2 is manually actuated, i.e. the contact system of the circuit breaker 2 is switched on and/or off and/or switched on again by way of an actuation switch embodied as a rocker 3. A latch (not shown) arranged in the housing of the circuit breaker 2 is used to actuate rotation of a selector shaft (not shown) with the aid of the rocker 3 and to open the switching contact (not shown) in the event of a short-circuit or overcurrent. In such cases the force needed to switch on and/or off is transferred from the rocker 3 via the latch to the moveable contact piece of the circuit breaker 2.

Figure 7:
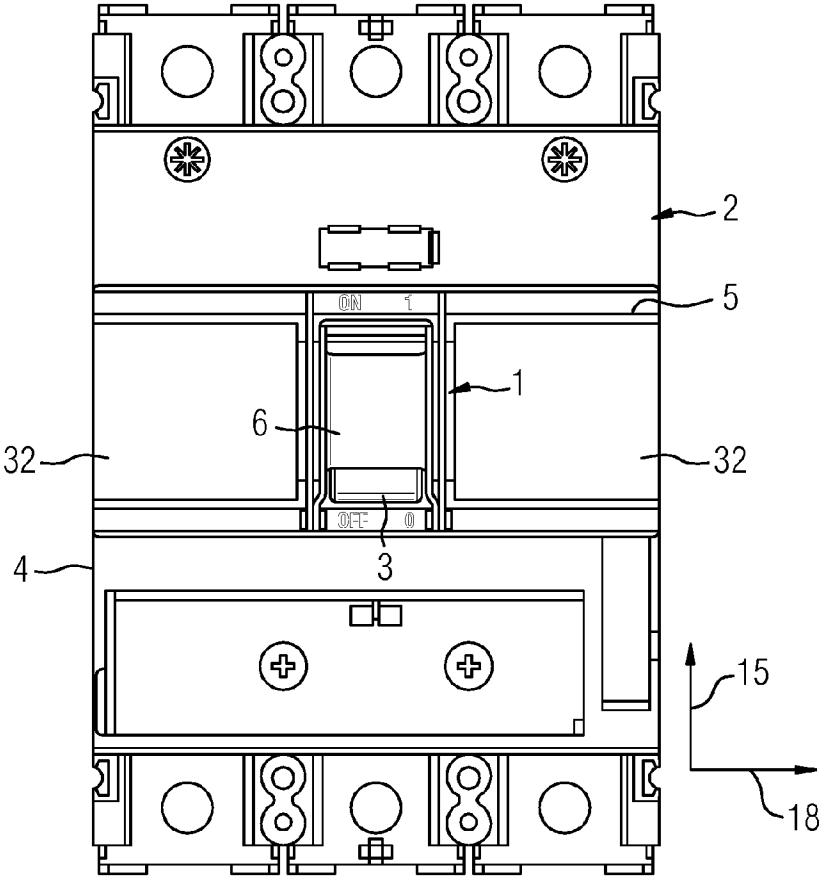
FIG. 7 shows a top view onto a circuit breaker having a mounted locking apparatus.

A cover 5 with a recess 6 for the rocker 3 is provided on the front panel of the housing 4 of the circuit breaker 2, see FIG. 7. The rocker 3 protrudes from the cover 5. The rocker 3 may assume at least two stable end positions. The rocker 3 is always in the "OFF position" in the figures.

The locking apparatus 1 is essentially structured symmetrically along a central longitudinal plane 7, see FIG. 1. An essentially U-shaped base body 8 of the locking apparatus 1 rests in the assembled state with its lower side of the U-base 9 on the surface of the circuit breaker 2, as explained again in more detail below.

The locking apparatus 1 has two fastening elements 11, wherein each fastening element 11 has a lateral surface 13 running essentially parallel to the U-sides 12 of the base body 8 and a foot part 14 connecting to the lateral surface 13. The foot parts 14 are used here to embody the mechanical connection with the circuit breaker 2, while the lateral surface 13, as is described in more detail below, are used as functional surfaces to lock the mechanical connection with the circuit breaker 2 and to close the locking apparatus 1. Two openings 16 for receiving guide bolts 17 are provided in the lower region of the lateral surfaces 13 at a height, distanced from one another in the longitudinal direction 15, see FIGS. 1 and 6. The fastening elements 11 can be moved manually in the transverse direction 18 on these guide bolts 17.

Figure 2:
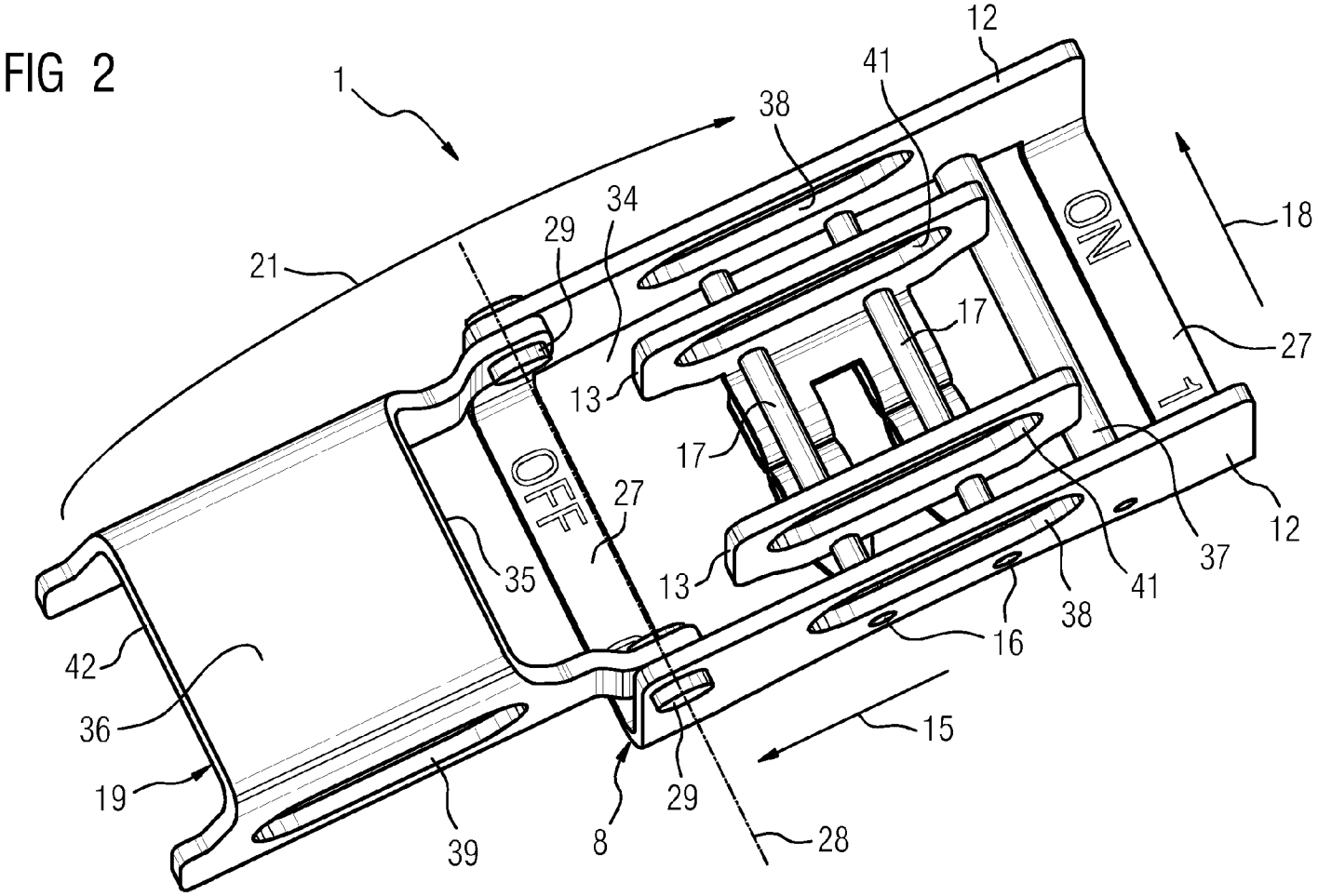
FIG. 2 shows a perspective view of the locking apparatus from FIG. 1.

At the end of the locking apparatus 1 which corresponds to the "OFF" position of the rocker 3, a safety clamp 19 which can be pivoted in the longitudinal direction 15 is hinged on the U-sides of the base body 8, the safety clamp being used as a locking element, see FIG. 2. The safety clamp 19 is likewise essentially embodied to be U-shaped.

The fastening elements 11 moved toward one another in the separated position, see FIGS. 1 and 2, positioned approximately centrally relative to the base body 9, are manually moved away from one another after positioning on the circuit breaker 2, namely toward the U-sides 12 of the base body 8, i.e. at right angles to the turn direction 21 of the safety clamp 19. In this process the U-shaped and/or hook-shaped foot parts 14 of the fastening elements 11 are suspended in pocket-type receiving openings 22 provided accordingly on the top side of the circuit breaker 2, see FIGS. 9 and 10. The foot parts 14 of the fastening elements 11 embodied as retaining elements are embodied with slots, so that foot ends 23 engage in pairs in each instance in pockets 22 on the switching device surface 24 which are provided accordingly with a central bar and embody a form and/or force-fit connection, see FIGS. 4 and 6. The foot ends 23 of the two fastening elements 11 point here in opposite directions, i.e. away from one another and the openings of the pockets 22 point toward one another.

Figure 8:
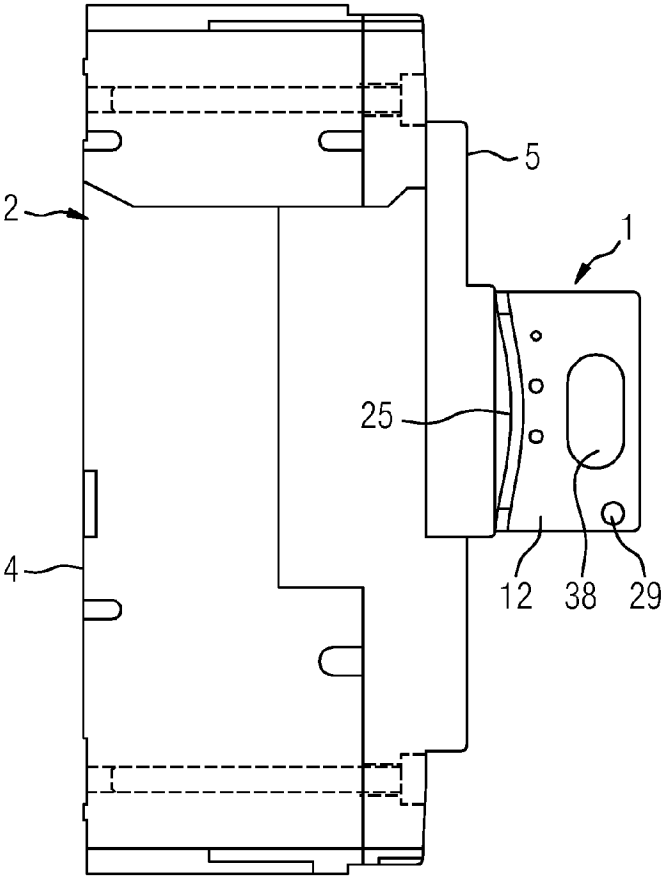
FIG. 8 shows the circuit breaker having a locking apparatus from FIG. 7 in a side view.
Figure 9:
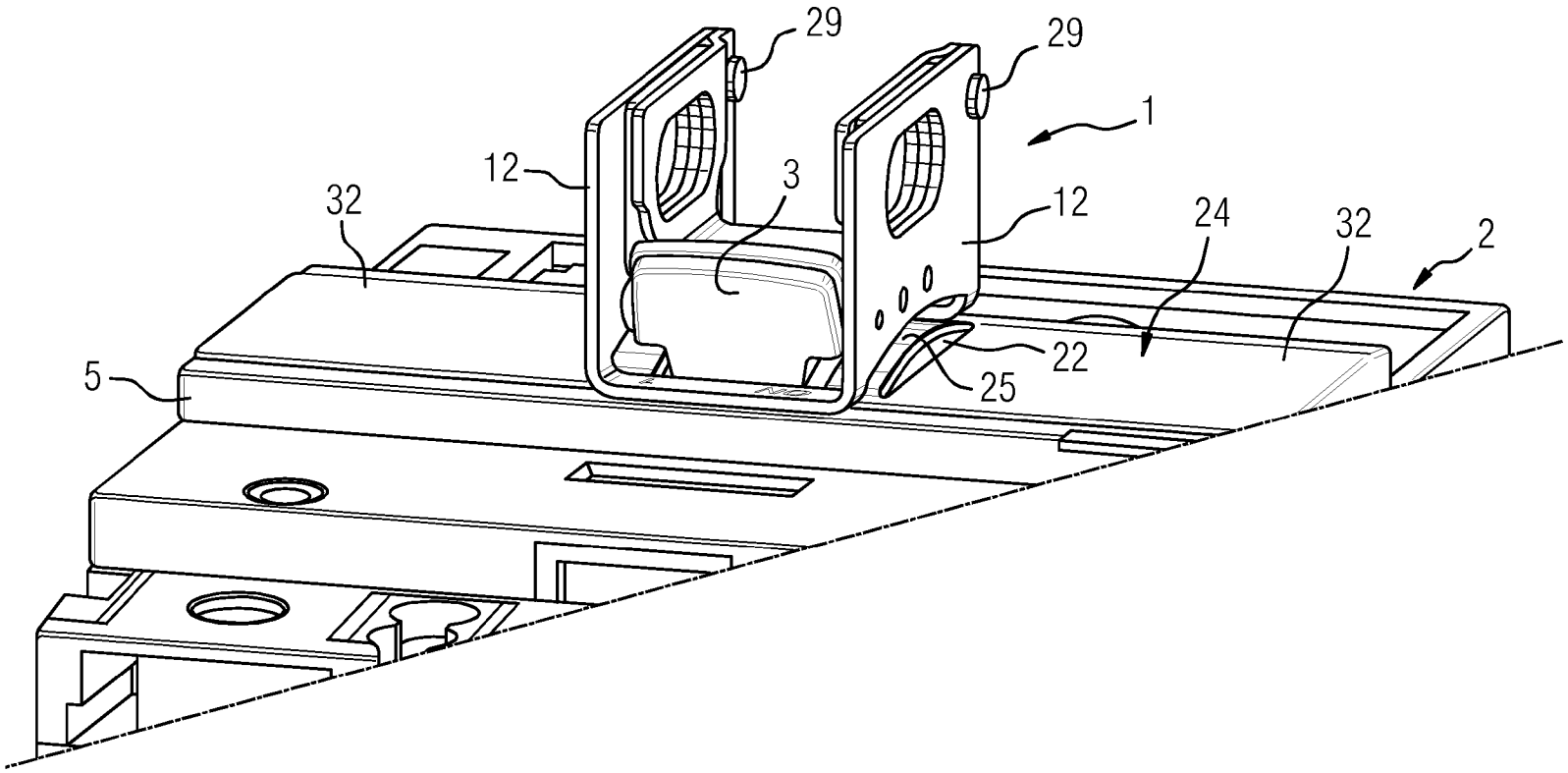
FIG. 9 shows a first perspective representation of a locking apparatus mounted on a circuit breaker.
Figure 10:
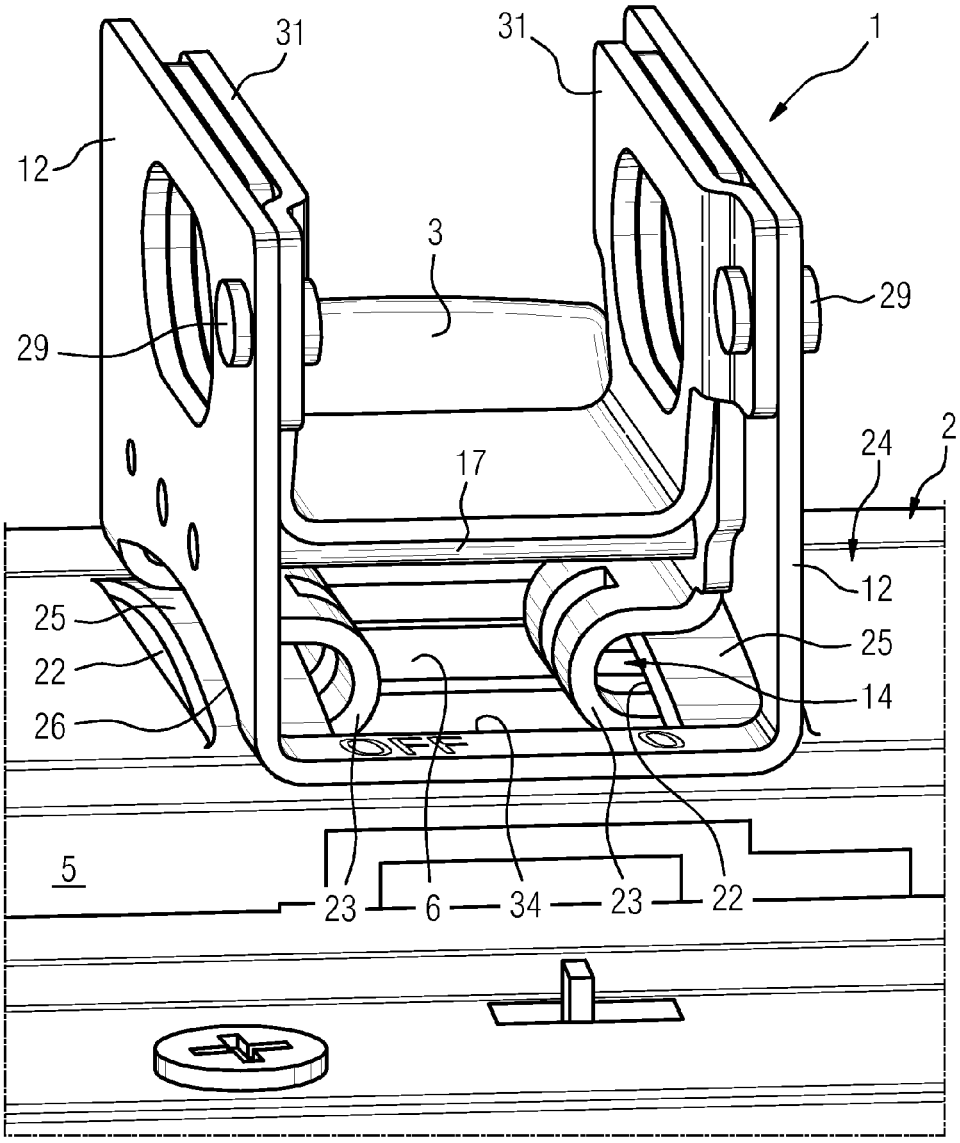
FIG. 10 shows a second perspective representation of a locking apparatus mounted on a circuit breaker.

In the embodiments shown in the Figures, arched retaining bridges 25 are attached to the surface 24 of the circuit breaker 2 on both sides of the recess 6 for the rocker 3, the retaining bridges running in parallel to the direction of movement 21 of the rocker 3, see FIGS. 8 to 10. The space spanned by the retaining bridges 25 forms the recesses 22 for the foot ends 23 of the fastening element 11. The U-base 9 and the lower edges 26 of the U-sides 12 of the base body 8 are embodied correspondingly in an arched manner relative to the planar contact on the retaining bridges 25, see FIGS. 4 and 6. The connecting bars 27 provided between the U-sides 12 at both ends of the base body 8 are adjacent to the retaining bridges 25 on the planar contact 24 of the circuit breaker 2 in the assembled state. This variant is advantageous in that the retaining bridges 25 can also subsequently be attached so that the use of the inventive locking apparatus 1 is also possible with circuit breakers 2 which already exist.

Alternatively, but not shown in the Figures however, in the case of full contact of the locking apparatus 1 on the circuit breaker 2, recesses can also be countersunk into the circuit breaker 2. The recesses pointing toward one another with their openings are then countersunk so deep into the circuit breaker 2 that the foot ends 23 of the fastening element 11 protruding downwards out of the lower side of the U-base 9 of the base body 9 of the locking apparatus 1 can engage in the recesses with a corresponding movement of the fastening element 11 in the transverse direction 18, if the locking apparatus 1 is attached with its base body 8 in a planar manner onto the circuit breaker 2.

Figure 3:
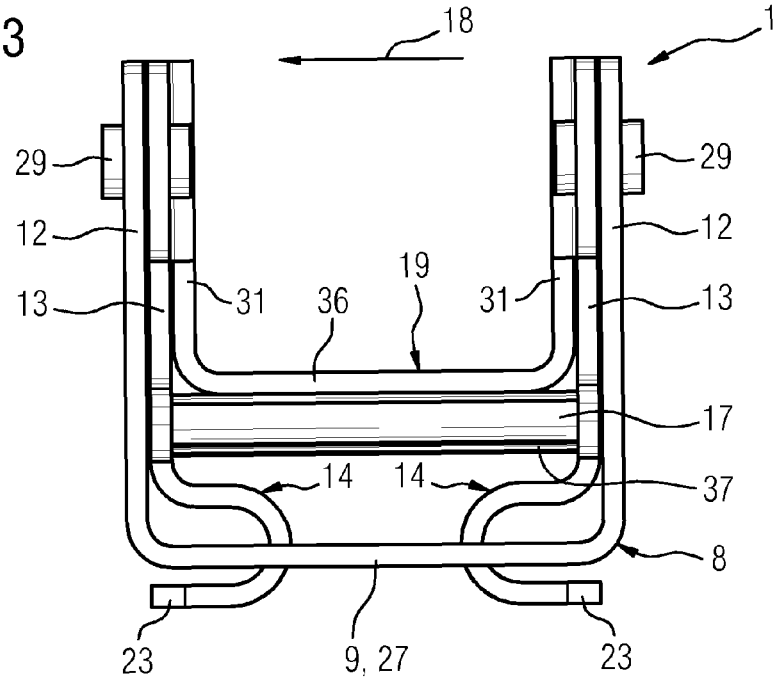
FIG. 3 shows a side view of the locking apparatus in a longitudinal direction (connected position)
Figure 4:
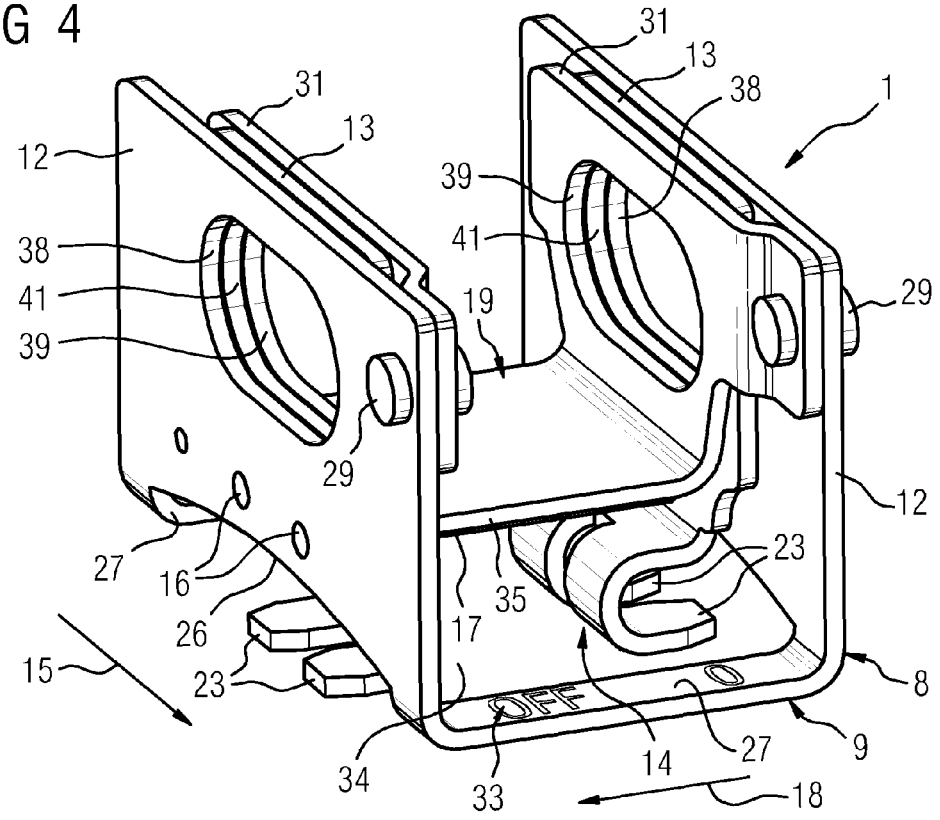
FIG. 4 shows a perspective view of the locking apparatus from FIG. 3.
Figure 5:
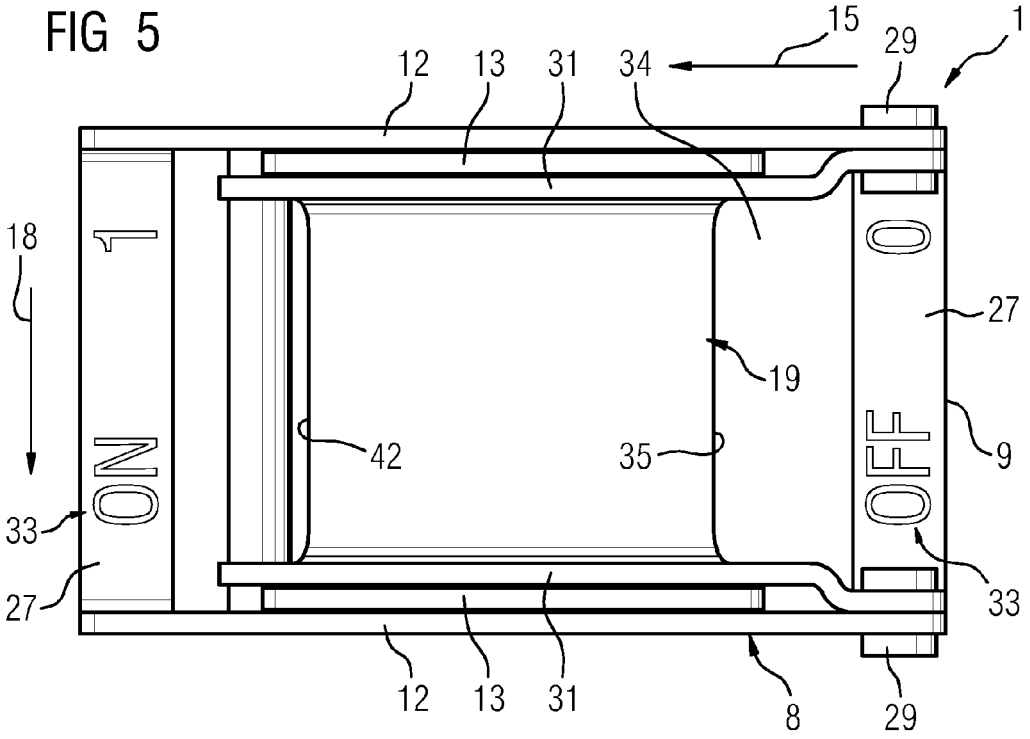
FIG. 5 shows a top view of the locking apparatus from FIG. 3.
Figure 6:
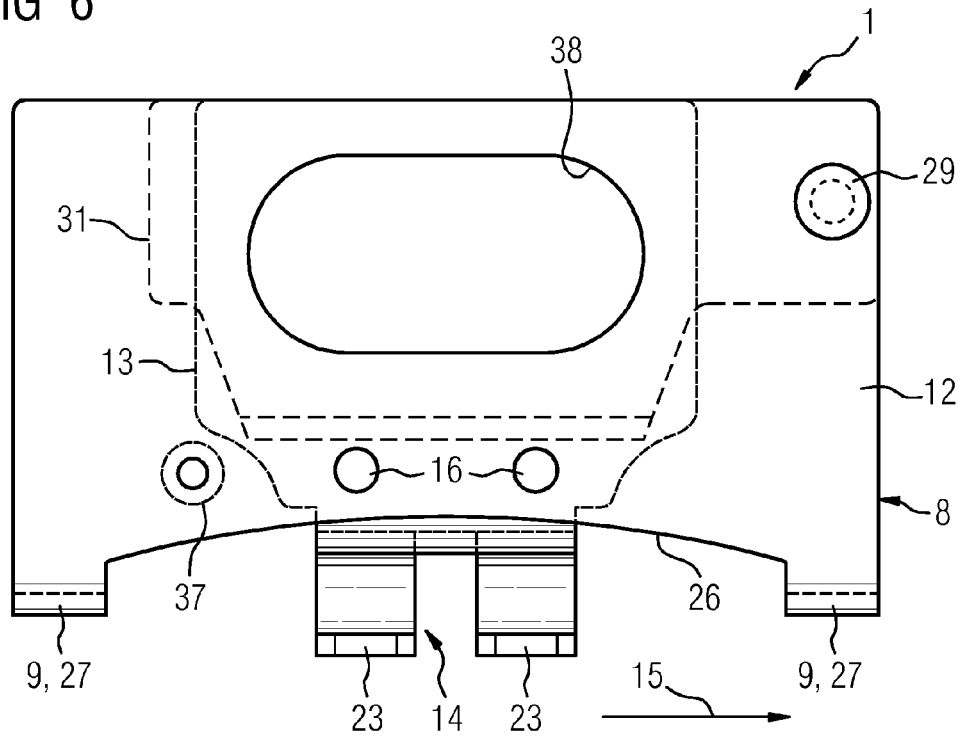
FIG. 6 shows a side view of the locking apparatus from FIG. 3 in the transverse direction.

In the connected position, the fastening elements 11 are moved outwards on the guiding bolts 17 to such a degree that the lateral surfaces 13 rest on the inner free surfaces of the U-sides 12 of the base body 8, see FIGS. 3 to 5. The mechanical connection of the locking apparatus 1 to the circuit breaker 2 is secured here such that the safety clamp 19 is manually transferred from the open position into a locking position by it being swiveled about a swivel axis 28, which runs through the two pivot points 29 in the transverse direction 18, onto the fastening element 11. After such swiveling of the safety clamp 19 from the open position into the locking position, the exteriors of the U-sides 31 of the safety clamp 19 rest on interiors of the lateral surfaces 13 of the fastening elements 11 which point toward one another. The lateral surfaces 13 of the fastening element 11 are therefore fixed between the U-sides 12 of the base body 9 on the one hand and the U-sides 31 of the safety clamp 19 on the other hand, so that displacement of the fastening element 11 in the transverse direction 18 is ruled out. The mechanical securing of the fastening element 11 in its connected position is thus established.

Since the locking apparatus 1 is embodied essentially in the form of a frame which can be mounted directly adjacent to the rocker 3, surfaces 32 of the circuit breaker 2 provided adjacent to the rocker 3, which can be used for the label, are not hidden, see FIG. 7. The connecting bars 27 of the base body 8 are also embodied in a width which not only secures an adequate mechanical stability of the base body 8, but instead also allows for a label, see FIG. 5. For instance, the connecting bars 27 with markers 33 are provided for the switching state of the circuit breaker 2.

During installation of the locking apparatus 1 on the circuit breaker 2, the rocker 3 of the circuit breaker 2 is always in the "OFF" position in the example embodiment of the invention shown here, see FIGS. 7 to 10. The rocker 3 protrudes here through the recess 6 in the circuit breaker 2 and an opening 34 provided in the base body 9 of the locking apparatus 1. By moving the safety clamp 19 into the locking position, a movement of the rocker 3 in the longitudinal direction 15, toward the "ON" position, is locked. The locking process brings about a transverse edge 35 of the U-base 36 of the safety clamp 19, which is used as a stop element for locking the rocker 3 in the "OFF" position. In other words, the dimension of the U-base 26 of the safety clamp 18 in the longitudinal direction 15 is selected, see FIG. 2, such that such a distance exists between the transverse edge 35 of the U-base 36 of the safety clamp 19 lying closest to the pivot points 29 on the one hand and the pivot points 29 of the safety clamp 19 on the base body 8 on the other hand, the distance being sufficient to pivot the safety clamp 19 into the locking position by way of the rocker 3 protruding out of the opening 34 of the base body 8, wherein on the other hand a change in position of the rocker 3 out of this position is still prevented by the transverse edge 35 however.

The opening 34 in the U-base 9 of the base body 8 extends to the side of the locking apparatus 1 facing the pivoted safety clamp 19, on which side the rocker 3 would be arranged if it was in its "ON" position. The opening 34, adjacent to the fastening elements 11, is closed there by a transverse locking pin 37 arranged between the U-sides 12 of the base body 8 in parallel to the guide bolts 17 and at a height relative thereto such that assembly of the locking apparatus 1 on the circuit breaker 2 is not possible if the rocker 3 is in the "ON" position, see FIG. 2. If this locking pin 37 is removed, for instance pried out of the base body 8 with the aid of a gripper or suchlike, assembly of the locking apparatus 1 is also possible when the circuit breaker 2 is switched on. In other words, the "ON" position can then also be secured. The transverse edge 42 of the U-base 36 of the safety clamp 19 facing the first transverse edge 25 is used in this case as a stop element for the rocker 3.

In the example embodiment shown the opening 34 for the rocker 2 is a single continuous opening provided in the U-base 9 of the base opening 8, cf. FIG. 5. Two individual openings which arranged separately from one another can however also be provided in the U-base 9 to receive the rocker 3.

The U-sides 12, 31 of the base body 8 and safety clamp 10 rest in the locking position on the lateral sides 13 of the fastening elements 11 and/or are arranged adjacent to one another so that the locking apparatus 1 can be closed in a particularly simple manner. The present invention therefore not only provides a rocker locking apparatus but at the same time also a rocker closing apparatus.

To this end, openings 38, 39, 41 for attaching a lock (not shown) or another locking device are provided in the base body 8, the safety clamp 19 and the lateral surfaces 13 of each fastening element 11. The structural design with opposite sides 12, 31 and/or functional surfaces 13 enables these openings 38, 39, 41 to be used in larger numbers and/or openings with a large diameter, as a result of which the use of different types of locking devices and/or the use of several locking devices is possible. In the example embodiment shown, the openings 38, 39, 41 are congruent longitudinal holes lying one above the other in the assembled state, see FIGS. 9 and 10, which are preferably embodied such that up to three U-locks of for instance 6 to 8 mm and/or ¼ to ⅜ inches can be used simultaneously for closure purposes.

An embodiment of the inventive locking apparatus 1 is characterized by a combination of a few, interlocking construction elements which are attuned to one another in terms of structure and function. Here a locking element 19 assumes a double function by it securing on the one hand the connection of the locking apparatus 1 with the switching device 2 and on the other hand reliably preventing a change in position of the actuation element 3 of the switching device 2.

Although the invention was illustrated and described in more detail by the preferred example embodiment, the invention is not restricted to the disclosed examples and other variations can be derived herefrom by the person skilled in the art without departing from the scope of protection of the invention.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE CHARACTERS

1 Locking apparatus
2 Circuit breaker
3 Rocker
4 Switch housing
5 Cover
6 Recess
7 Central longitudinal plane
8 Base body
9 U-base of the base body
10 (free)
11 Fastening element
12 U-side of the base body
13 Lateral surface of the fastening element
14 Foot part of the fastening element
15 Longitudinal direction
16 Opening for guide bolts
17 Guide bolts
18 Transverse direction
19 Safety clamp
20 (free)
21 Swivel direction
22 Receiving opening on the switching device
23 Foot end
24 Surface of the switching device
25 Retaining bridge
26 Lower edge of the U-side
27 Connecting bars
28 Swivel axis
29 Pivot point
30 (free)
31 U-side of the safety clamp
32 Labeling surface
33 Marker
34 Opening in the base body

35 Transverse edge
36 U-base of the safety clamp
37 Securing pin
38 Lock opening of the base body
39 Lock opening of the safety clamp
40 (free)
41 Lock opening of the fastening element
42 Transverse edge

What is claimed is:

1. A locking apparatus for fastening on an electromechanical switching device, the switching device including an actuation element for switching the switching device at least one of on and off, the switching device being transferrable from one first position into a second position, the locking apparatus comprising:

a base body, including an opening configured to receive the actuation element of the switching device;

at least one fastening element, laterally moveable relative to side walls of the base body, configured to fasten the locking apparatus on the switching device, wherein the at least one fastening element is transferrable from a separated position from the side walls into a connected position with the side walls to embody a mechanical connection with the assembly element; and a locking element, arranged moveably on the base body and being transferrable from an open position into a locking position whereby the locking element is between side walls of the at least one fastening element and the side walls of the base body for mechanical securing of the at least one fastening element, the locking element being embodied such that, in the locking position, the locking element is configured to prevent a change in position of the actuation element of the switching device upon the locking apparatus being fastened on the switching device, wherein the at least one fastening element comprises at least one retaining part, configured to embody at least one of a force and form-fit connection with the switching device by engaging in a receiving opening beneath a surface of a cover of the switching device upon the at least one fastening element being moved from the separated position into the connected position.

2. The locking apparatus of claim 1, wherein a direction of movement of the at least one fastening element runs at right angles to a direction of movement of the locking element.

3. The locking apparatus of claim 1, wherein a direction of movement of the locking element runs parallel to a direction of movement of the actuation element of the switching device.

4. The locking apparatus of claim 1, wherein the first position is the "OFF" position, and wherein the locking element comprises a first stop element for locking the "OFF" position of the actuation element of the switching device.

5. The locking apparatus of claim 1, wherein the second position is the "ON" position, and wherein the locking element comprises a stop element for locking the "ON" position of the actuation element of the switching device.

6. The locking apparatus of claim 5, further comprising:

a securing element, distanceable from and connected to the base body, configured to mechanically lock a positioning of the actuation element of the switching device on the second stop element upon the actuation element being in the "ON" position.

7. The locking apparatus of claim 1, wherein the base body and the locking element which includes at least one fastening element and at least one construction element, allows the position of these components relative to one another to be defined with the aid of a locking apparatus such that release of the mechanical connection between the locking apparatus and the switching device is ruled out.

8. The locking apparatus of claim 7, wherein the at least one construction element includes a plurality of construction elements which are through openings for receiving a lock, the through openings being arranged directly adjacent to one another upon the locking apparatus being fastened on the switching device.

9. An electromechanical switching device comprising:

a manual actuation option; and at least one retaining bridge on a surface of the switching device configured to embody a mechanical connection to a fastening element of a locking apparatus of claim 1.

10. The locking apparatus of claim 1, wherein the electromechanical switching device is a circuit breaker.

11. The electromechanical switching device of claim 9, where the electromechanical switching device is a circuit breaker.

12. The locking apparatus of claim 1, wherein a direction of movement of the at least one fastening element is movable in a direction at right angles to a direction of movement of the locking element.

13. The locking apparatus of claim 1, wherein a direction of movement of the locking element is parallel to a direction of movement of the actuation element of the switching device.

14. The locking apparatus of claim 2, wherein a direction of movement of the locking element is parallel to a direction of movement of the actuation element of the switching device.

15. The locking apparatus of claim 12, wherein a direction of movement of the locking element is parallel to a direction of movement of the actuation element of the switching device.

16. The locking apparatus of claim 4, wherein the second position is the "ON" position, and wherein the locking element comprises a second stop element for locking the "ON" position of the actuation element of the switching device.

17. The locking apparatus of claim 16, further comprising:

a securing element, distanceable from and connected to the base body, configured to mechanically lock a positioning of the actuation element of the switching device on the second stop element upon the actuation element being in the "ON" position.

18. An electromechanical switching device comprising:

a manual actuation option; and at least one retaining bridge on a surface of the switching device configured to embody a mechanical connection to a fastening element of a locking apparatus of claim 1.

* * * * *